US005582563A

United States Patent [19]

Fan

[11] Patent Number: 5,582,563

[45] Date of Patent: Dec. 10, 1996

[54] ROWING EXERCISE MACHINE

[76] Inventor: Robert Fan, No. 7, Industrial N. 2 Road Nan Kang Industrial Zone, Nantou, Taiwan

[21] Appl. No.: 575,137

[22] Filed: Dec. 19, 1995

[51] Int. Cl.[6] ..... A63B 21/00

[52] U.S. Cl. ..... 482/96; 482/95; 482/72

[58] Field of Search ..... 482/72, 96, 95, 482/112, 58, 57, 62, 73, 51

[56] References Cited

U.S. PATENT DOCUMENTS

| | | | |
|---|---|---|---|
| 2,642,288 | 6/1953 | Bell | 482/72 |
| 4,743,010 | 5/1988 | Geraci | 482/12 |
| 5,342,269 | 8/1994 | Huang et al. | 482/95 |
| 5,421,795 | 6/1995 | Chen | 482/96 |
| 5,478,298 | 12/1995 | Chen | 482/95 |
| 5,512,027 | 4/1996 | Chen | 482/95 |

*Primary Examiner*—Jerome Donnelly
*Attorney, Agent, or Firm*—Browdy and Neimark

[57] ABSTRACT

A rowing exercise machine is made up of a base, a seat member and a control member. The base comprises a curved portion, an inclined portion and an arcuate portion. The inclined portion and the arcuate portion are provided respectively with a leg for supporting the base on a floor. The seat member comprises a seat rod which is fastened pivotally at one end thereof with the arcuate portion and is provided at another end thereof with a saddle. The control member comprises a driving frame and two handles. The driving frame is fastened pivotally with the arcuate portion of the base while the handles are fastened with the seat rod of the seat member. The driving frame is provided with two pedals fastened thereto. The handles are fastened respectively with a connection rod which is fastened pivotally at the bottom end thereof with a roller. The connection rods are actuated by the handles so as to cause the saddle to move upwards.

4 Claims, 2 Drawing Sheets

ROWING EXERCISE MACHINE

FIELD OF THE INVENTION

The present invention relates generally to an exercise machine, and more particularly to an improved rowing exercise machine.

BACKGROUND OF THE INVENTION

The prior art rowing exercise machines are generally composed of oil-pressure cylinders for providing the machines with the damping effect. The oil-pressure cylinders are vulnerable to oil leaks and are therefore messy. In addition, the rowing exercise machines equipped with the oil-pressure cylinders are rather insipid and monotonous in design in that they afford their users only the forward and the backward rowing motions.

SUMMARY OF THE INVENTION

It is therefore the primary objective of the present invention to provide a rowing exercise machine, which is devoid of the oil pressure cylinders.

It is another objective of the present invention to provide a rowing exercise machine capable of animating the rowing by allowing its users to do not only the forward and the backward rowing motions but also the up-and-down rowing motions.

The foregoing objectives of the present invention are attained by a rowing exercise machine, which comprises a base, a seat member, and a control member. The base has a curved portion, an inclined portion extending from the hind end of the curved portion, and an arcuate portion extending from the front end of the curved portion. The inclined portion and the arcuate portion are provided respectively with a leg serving as a support of the base on a floor or ground. The seat member comprises a seat rod which is fastened pivotally at one end thereof with the arcuate portion and is provided at another end thereof with a saddle. The control member comprises a driving frame and two handles. The driving frame is fastened pivotally with the arcuate portion of the base while two handles are fastened with the seat rod of the seat member. The driving frame is fastened pivotally with the seat rod by means of a connection rod and is provided respectively at both sides of the bottom end thereof with a pedal. The handles are fastened respectively with a connection rod which is fastened pivotally at the bottom end thereof with a roller. The connection rods are actuated by the handles so as to cause the saddle to move upwards.

The foregoing objectives, features and advantages of the present invention will be more readily understood upon a thoughtful deliberation of the following detailed description of the present invention in conjunction with the accompanying drawings.

DETAILED DESCRIPTION OF THE INVENTION

Figure 1:
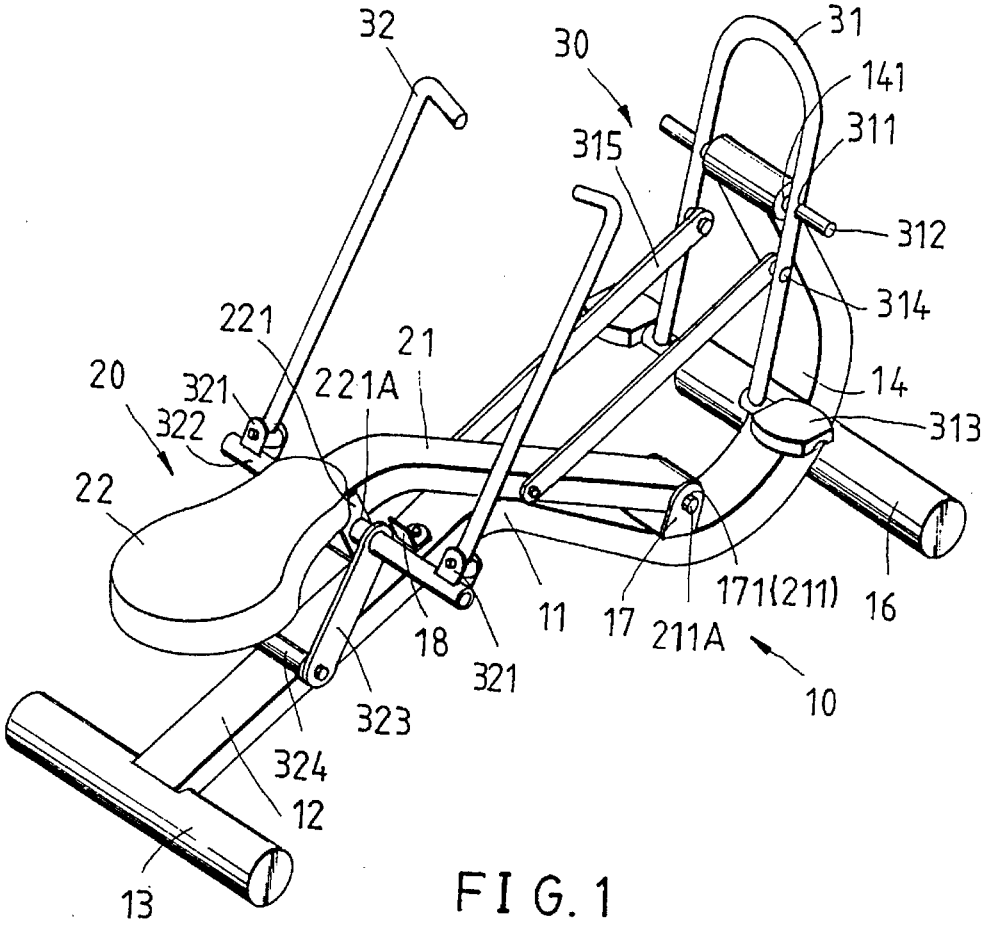
FIG. 1 shows a perspective view of an embodiment of the present invention.

As shown in FIGS. 1–4, a rowing exercise machine embodied in the present invention comprises a base 10, a seat member 20, and a control member 30.

The base 10 of a curved and rod-shaped construction comprises a curved portion 11, an inclined portion 12 extending from the hind end of the curved portion 11, and an arcuate portion 14 extending from the front end of the curved portion 11 such that the arcuate portion 14 is provided with an activity space 15. The arcuate portion 14 is provided at the bottom thereof with a leg 16 fastened thereto for supporting the base 10 on a floor or ground. Similarly, the inclined portion 12 is provided at the bottom thereof with a leg 13 for supporting the base 10 on a floor or ground in conjunction with the leg 16 of the arcuate portion 14. The arcuate portion 14 is provided at the top end thereof with a pivoting hole 141 and is further provided with two pivoting lugs 17 which are contiguous to the curved portion 11 and are provided respectively with an axial hole 171. The inclined portion 12 is provided with an L-shaped stopping piece 18 contiguous to the curved portion 11.

The seat member 20 comprises a seat rod 21 which is provided at the front end thereof with an axial hole 211 engageable with a pin 211A for fastening pivotally the seat rod 21 with the pivoting lugs 17 of the base 10. The seat rod 21 is provided at the rear end thereof with a saddle 22 fastened thereto. The seat rod 21 is further provided at the midsegment thereof with a pivoting hole 212. The saddle 22 is provided at the center of the underside thereof with two pivoting lugs 221 which are provided respectively with a pivoting hole 221A.

Figure 3:
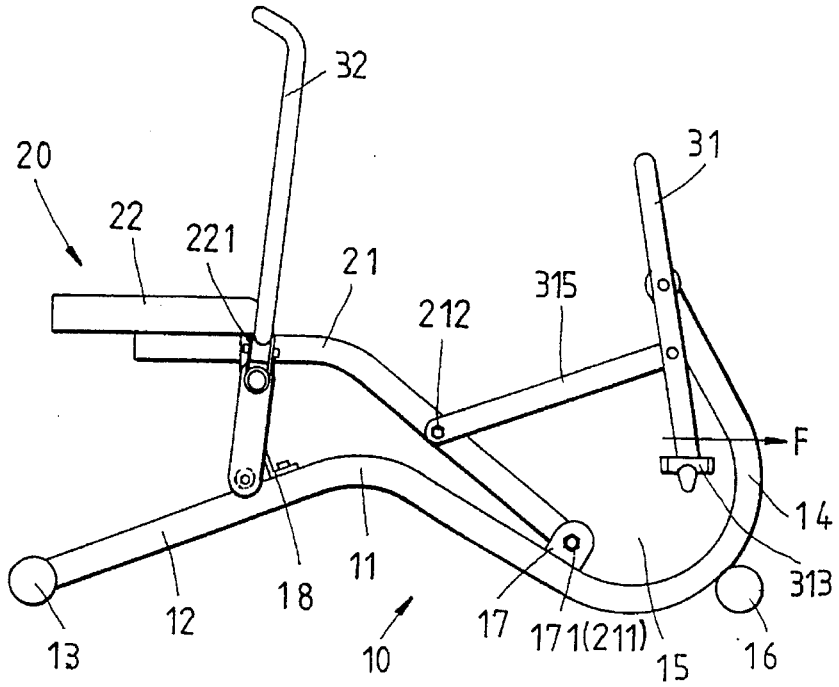
FIG. 3 shows a schematic view of the embodiment of the present invention at work.
Figure 4:
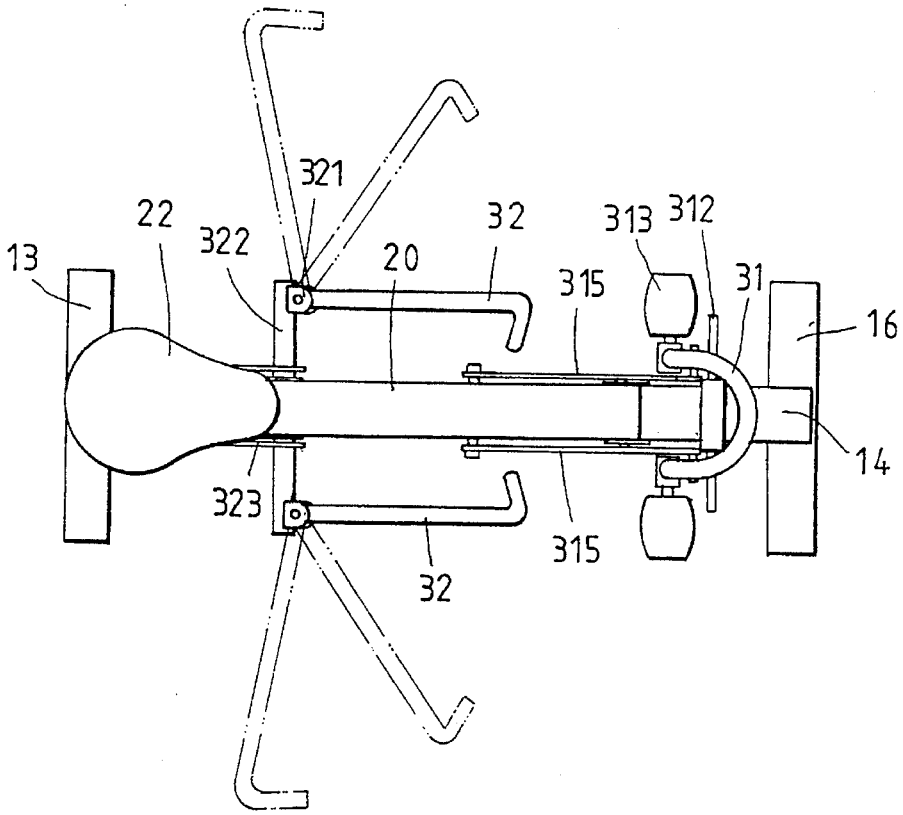
FIG. 4 shows another schematic view of the embodiment of the present invention at work.

The control member 30 comprises a driving frame 31 and two handles 32. The driving frame 31 of an inverted U-shaped construction is provided with through holes 311 engageable with a rod 312 which is also engageable with the pivoting hole 141 of the arcuate portion 14. Fastened with the free ends of the driving frame 31 are two pedals 313. The driving frame 31 is further provided with through holes 314 engageable with a first pair of connection rods 315 which are in turn engageable with the pivoting holes 212 of the seat rod 21. As a result, the frame 31 can be actuated by the pedals 3 13 so as to push the seat rod 21 forward, as illustrated in FIG. 3. The handles 32 are provided with two pivoting lugs 321 for fastening with a shaft 322 which is held by the pivoting lugs 221 of the saddle 22. The shaft 322 is provided integrally with a second pair of connection rods 323 for fastening pivotally with a roller 324. When the handles 32 are moved forward, backwards, leftwards and rightwards to imitate the rowing, the the second pair of connection rods 323 are caused to swing with the shaft 322 serving as an axis, as shown in FIGS. 3 and 4.

Figure 2:
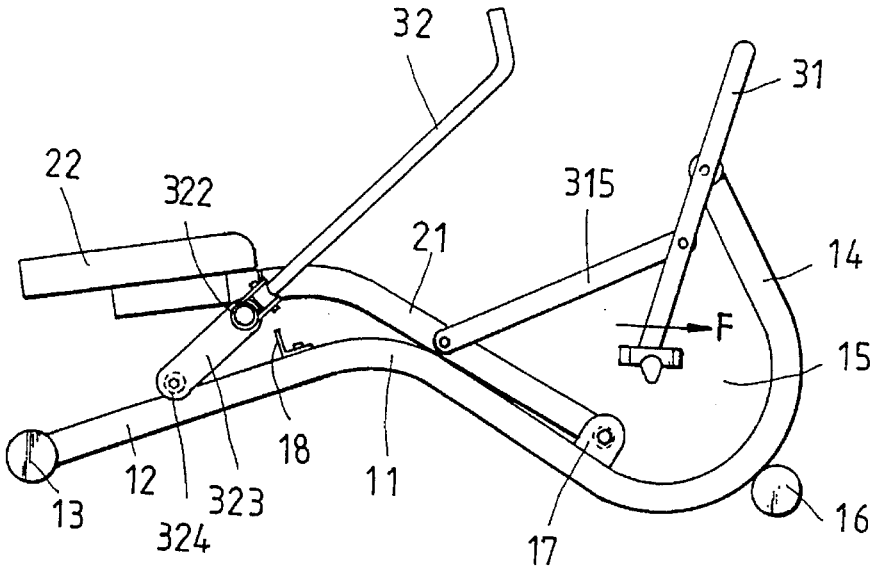
FIG. 2 shows a side view of the embodiment of the present invention.

In operation, the user of the device of the present invention is seated on the saddle 22, with both feet resting on the pedals 313 and with both hands holding securely the handles 32. As handles 32 are pulled simultaneously, the driving frame 31 is exerted on by a force F of both feet, as illustrated in FIGS. 2 and 3. As a result, the driving frame 31 is forced to move forward on the rod 3 12 engaging the pivoting hole 141 of the arcuate portion 14. The first pair of connection rods 3 15 are actuated by the forward motion of the driving frame 31 to cause the seat rod 21 to deflect. In addition, the second pair of connection rods 323 are raised upward gradually to position uprightly when the handles 32 are pulled backwards, thereby causing the roller 324 to move toward the stopping piece 18, as shown in FIG. 3. The roller 324 is finally obstructed by the stopping piece 18. In the process described above, the person sitting on the saddle 22 is elevated. As the handles 32 and the driving frame 31 are relieved of the external forces exerting thereon, the second pair of connection rods 323 are caused by the weight of the person sitting on the saddle 22 to actuate the roller 324 to move along the inclined plane of the inclined portion 12 back to its initial position shown in FIG. 2. The exercise process described above is repeated to bring about the rowing exercise.

The embodiment of the present invention described above is to be regarded in all respects as being illustrative and not restrictive. Accordingly, the present invention may be embodied in other specific forms without deviating from the spirit thereof. The present invention is therefore to be limited only by the scopes of the following appended claims.

What is claimed is:

1. A rowing exercise machine, which comprises an elongated base member having first supporting means on a first end of the base member, the base member extending upward from said first end along an inclined portion to a midsection of said base member, said base member then gradually curving downward from the midsection along a declining portion to an arcuate portion, said arcuate portion curving upward from the declining portion and a second supporting means attached to an under surface of the arcuate portion, a seat member comprising a seat rod fastened pivotally at one end thereof to an upperside of the base member along the arcuate portion of said base member, said seat rod provided at another end thereof with a saddle fastened thereto; and a control member comprising a driving frame pivotally fastened at a second end of the base member on said arcuate portion, and two handles pivotally fastened to said seat rod, said driving frame provided with a first pair of connection rods for pivotally fastening said driving frame to said seat rod, said driving frame further provided with two pedals fastened thereto, first ends of a second pair of connection rods integrally connected to said handles, a roller rotatably fastened to second ends of the second pair of connection rods, said roller rotating upward along the inclined portion of the base member and lifting the seat rod and seat when the handles are pulled towards a user on the seat.

2. The rowing exercise machine as defined in claim 1, wherein said inclined portion is provided with a stopping piece contiguous to said arcuate portion.

3. The rowing exercise machine as defined in claim 1, wherein a pivoting lug is fixed to said saddle and pivotally fastened to a rod, said rod being fastened to said handles and to the first ends of the second pair of connection rods, wherein when said handles are pulled toward the user the roller on the second pair of connection rods rotates upward along the inclined portion.

4. The rowing exercise machine as defined in claim 1, wherein said driving frame is of an inverted U-shaped construction and is fastened pivotally with said base.

* * * * *